US006467930B1

(12) United States Patent
Frick

(10) Patent No.: US 6,467,930 B1
(45) Date of Patent: Oct. 22, 2002

(54) HIGH-INTENSITY, WATER- AND SHOCK-RESISTANT FLASHLIGHT

(75) Inventor: Markus W. Frick, Syracuse, NY (US)

(73) Assignee: Reva International Limited, Hong Kong (HK)

( * ) Notice: Subject to any disclaimer, the term of this patent is extended or adjusted under 35 U.S.C. 154(b) by 51 days.

(21) Appl. No.: 09/611,053

(22) Filed: Jul. 6, 2000

(51) Int. Cl.[7] ..... F21L 4/04
(52) U.S. Cl. ..... 362/202; 362/158; 362/267
(58) Field of Search ..... 362/158, 202, 362/205, 267; 200/60

(56) References Cited

U.S. PATENT DOCUMENTS

| | | | | |
|---|---|---|---|---|
| 4,151,583 A | | 4/1979 | Miller | 362/205 |
| 4,325,107 A | | 4/1982 | MacLeod | 362/183 |
| 4,429,352 A | | 1/1984 | Griffin | 362/189 |
| 4,458,300 A | | 7/1984 | Walsh | 362/206 |
| 4,740,874 A | | 4/1988 | Wylie et al. | 362/268 |
| 4,748,544 A | | 5/1988 | Ince | 362/203 |
| 4,843,526 A | * | 6/1989 | Price, III | 362/205 |
| 5,165,782 A | | 11/1992 | Maglica et al. | 362/208 |
| 5,267,131 A | | 11/1993 | Anthony et al. | 362/208 |
| 5,309,337 A | | 5/1994 | Groben | 362/206 |
| 5,349,507 A | * | 9/1994 | Parker | 362/158 |
| 5,678,921 A | | 10/1997 | Kish et al. | 362/205 |
| 5,934,789 A | | 8/1999 | Sinclair et al. | 362/189 |
| 5,957,567 A | | 9/1999 | Kish et al. | 362/202 |
| 6,099,147 A | | 8/2000 | Ziegenfuss | 362/319 |

FOREIGN PATENT DOCUMENTS

| | | | | |
|---|---|---|---|---|
| FR | 1105942 | * | 5/1954 | 362/158 |
| GB | 2089015 | * | 6/1982 | 362/158 |

* cited by examiner

*Primary Examiner*—Sandra O'Shea
*Assistant Examiner*—Peggy A. Neils
(74) *Attorney, Agent, or Firm*—Eugene Stephens & Associates

(57) ABSTRACT

In a flashlight, a shock absorption system cushions the bulb of the flashlight from impulses delivered to the flashlight. The shock absorption system includes a resilient body with outer and inner rings connected by a membrane, the outer ring being supported by the casing of the flashlight and the membrane allowing a predetermined amount of motion of the inner ring relative to the outer ring. The resilient body also supports the rear of the reflector, which carries the bulb, in a frustroconical portion. When impulse is imparted to the flashlight, the front of the outer ring of the resilient body remains substantially stationary, but the inner ring travels, the resilient body absorbing energy from the impulse so that when the inner ring reaches the end of its travel, the reflector and bulb experience a reduced impulse. As long as the impulse remains below a predetermined level, the bulb sustains no damage. The flashlight includes a self-cleaning, multi-position magnetic switch that is easily disassembled and replaced.

26 Claims, 7 Drawing Sheets

HIGH-INTENSITY, WATER- AND SHOCK-RESISTANT FLASHLIGHT

TECHNICAL FIELD

The invention relates to flashlights, particularly of the high-performance, high-intensity variety.

BACKGROUND OF THE INVENTION

Particular niches have developed requiring very bright, durable flashlights. One such niche is law enforcement, where a police officer acting on a call at night will require high quality illumination of an investigation site. If the officer must chase a suspect, the flashlight must stay active despite the removal of the officer's finger from the switch and despite any shock the flashlight might experience during the chase including being dropped. If the officer must extinguish the flashlight in a hurry, its switch must operate easily and conveniently enough that the officer can extinguish the light without removing his or her attention from his or her investigation.

Another niche requiring bright, durable flashlights is search and rescue. Many of the requirements for search and rescue are the same as those for law enforcement. However, search and rescue often requires water resistance and penetration by the light beam through smoke, dust, fog, and other vision impairing atmospheric anomalies.

A third niche requiring bright, durable flashlights is diving, such as SCUBA diving. While the shock requirements are not as stringent as those for law enforcement and search and rescue, diving requires a high degree of water resistance and the ability of the light beam to penetrate through murky water.

Several bright, durable flashlights are available to these niches, but all currently available flashlights have drawbacks. One drawback is that none of the currently available flashlights can endure much in the way of shock; a fall from six feet onto concrete will render most useless. Another drawback is inadequate penetration of vision impairing anomalies, such as fog or murky water; the emission spectrum and light output of most currently available flashlights simply can not go very far through such anomalies. A drawback of those that can penetrate these anomalies to at least some acceptable degree is that they require additional, external power packs that are heavy and unwieldy.

SUMMARY OF THE INVENTION

My invention overcomes all of the drawbacks of the prior art by including a superior shock absorbing system, a superior light delivery system, and a superior power system. The shock absorbing system uses coaxial resilient annuli to support the bulb, absorbing impulse energy delivered to the bulb as the result of an impact of the casing against a more massive object (such as a concrete floor). This easily protects the bulb from a drop of six feet onto a concrete floor, and even allows a user to pound a large nail into a 4×4 with the bell of the flashlight without significant damage to the inner workings of the flashlight.

The light delivery system employs a metal halide bulb that produces light at an order of magnitude greater intensity than conventional halogen bulbs. Using this bulb, my flashlight can illuminate a spot up to ¾ mile away and can cut through fog, precipitation, and murky water.

I include a magnetic reed type switch that is self cleaning and allows for easy replacement. The switch includes a retractable shoulder strap mount.

DESCRIPTION OF THE INVENTION

Figure 1:
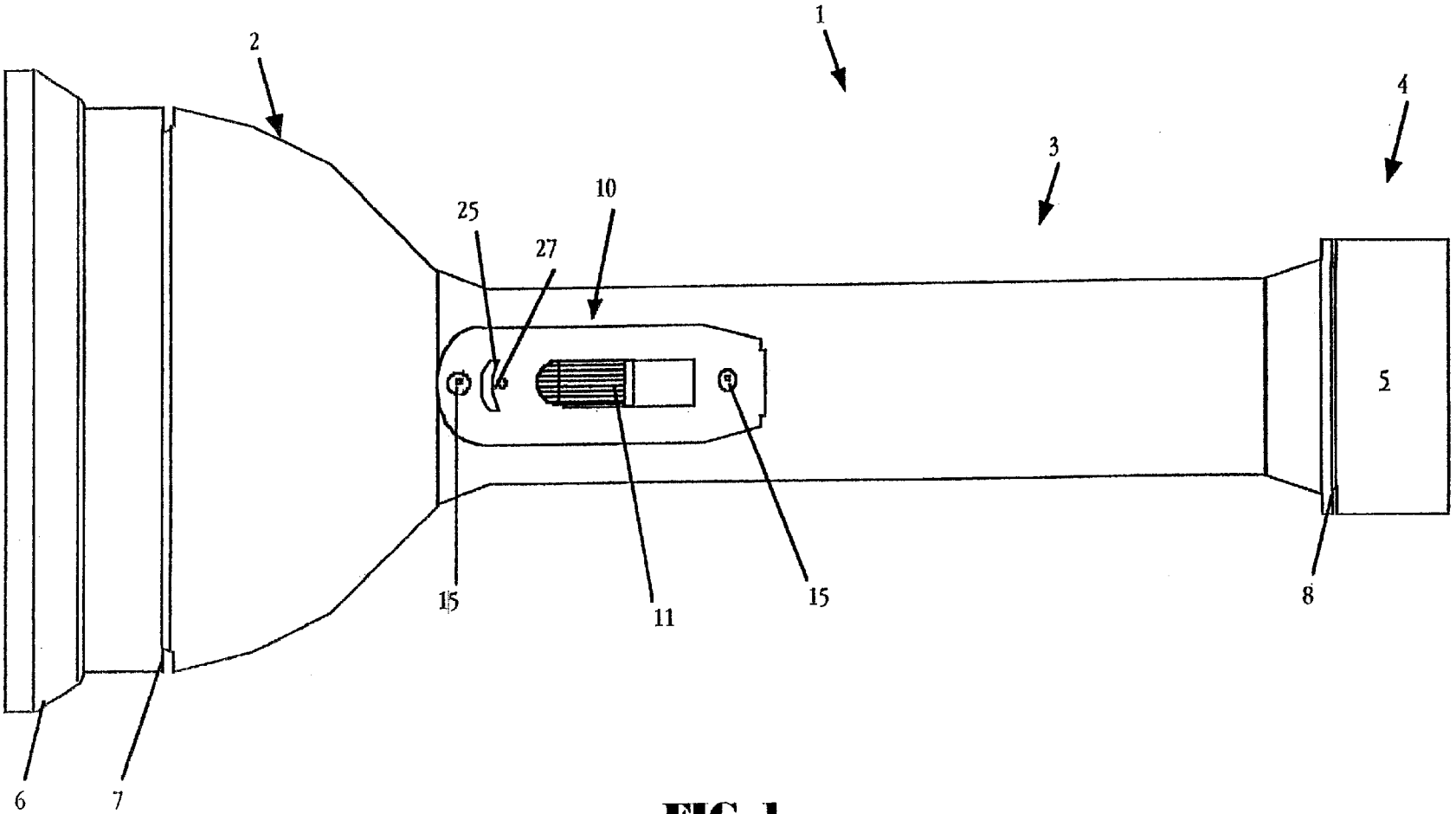
FIG. 1 is an elevational side view of an embodiment of my flashlight.
Figure 2:
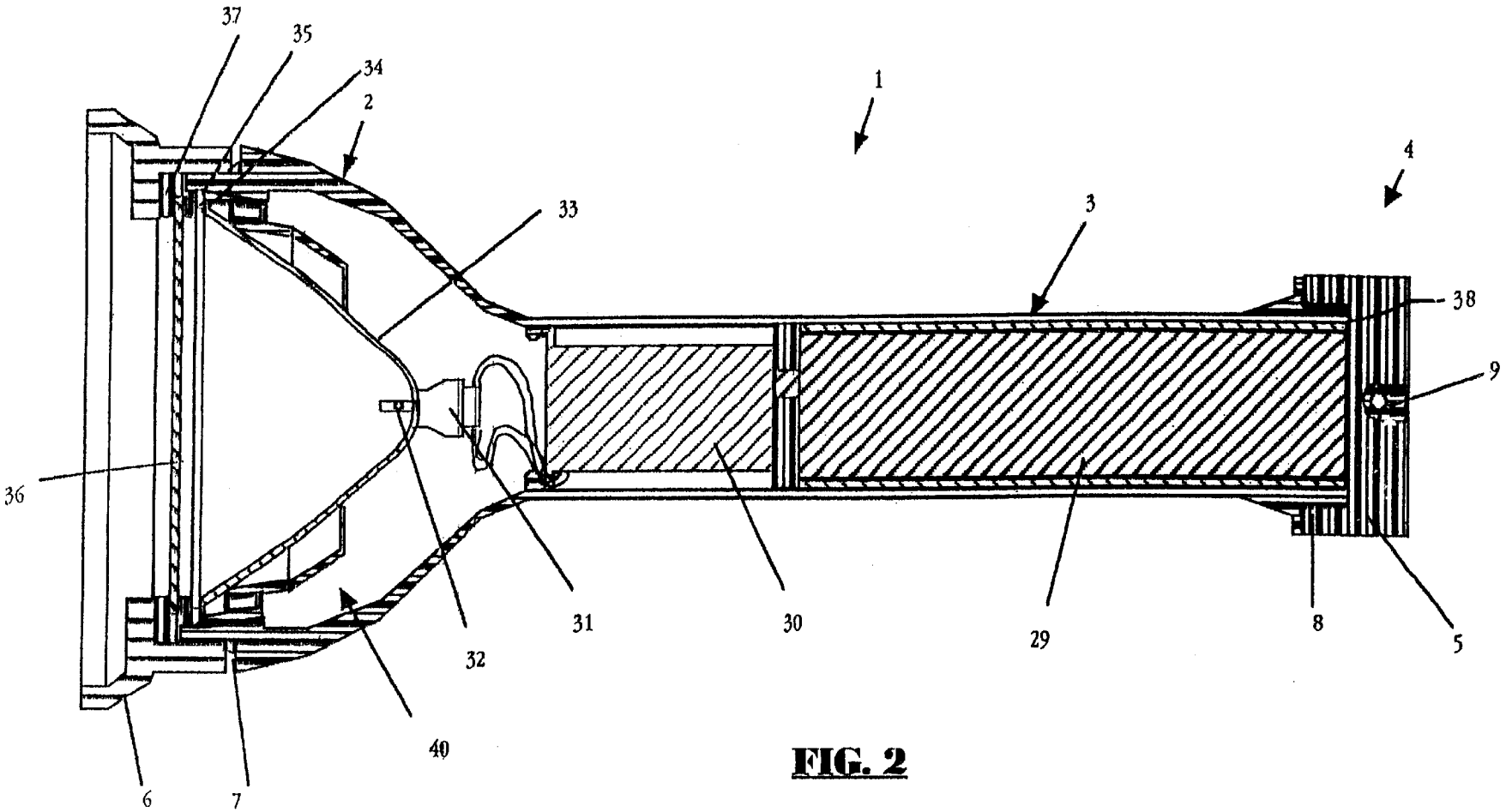
FIG. 2 is a cross section of the flashlight show in FIG. 1.
Figure 3:
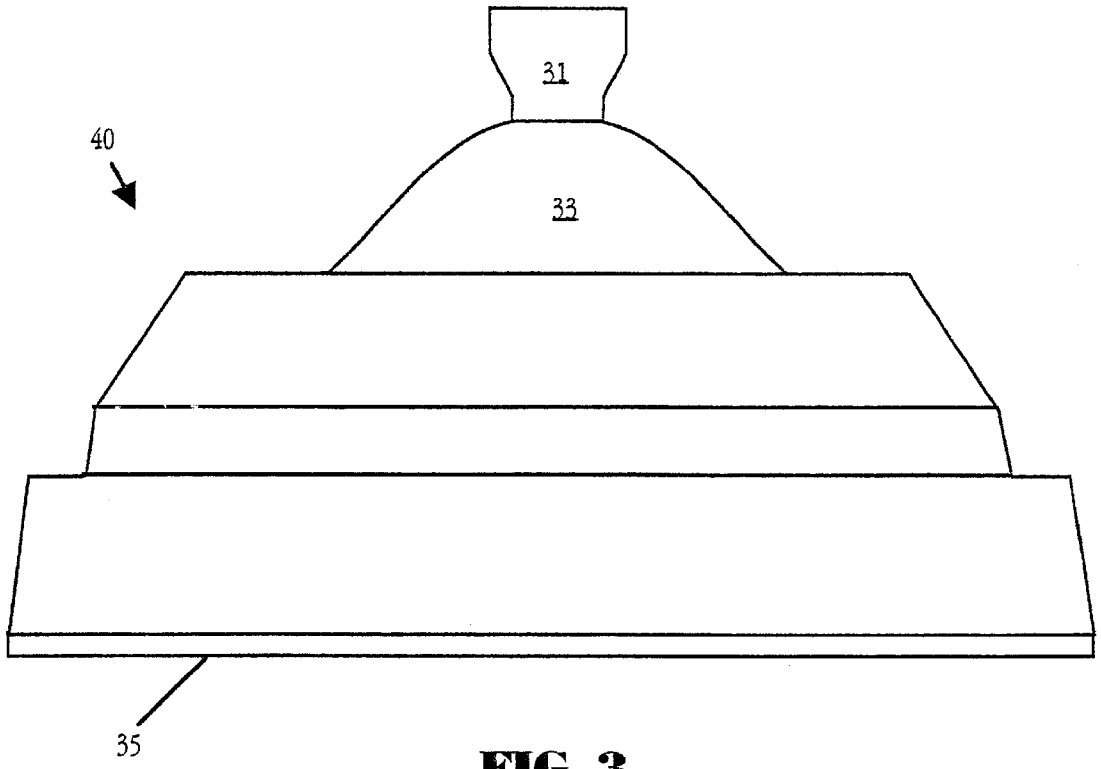
FIG. 3 is an elevational side view of the shock absorption system, reflector, and bulb of the flashlight shown in FIG. 1.
Figure 4:
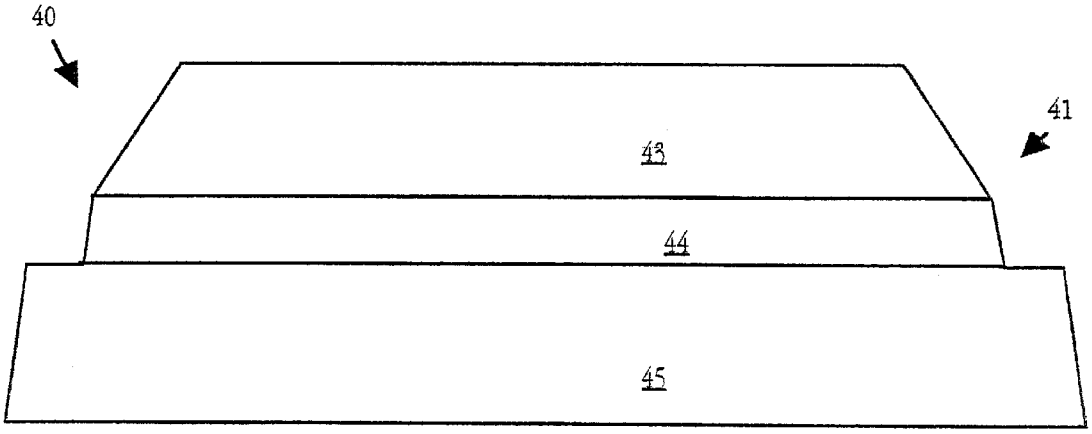
FIG. 4 is an elevational side view of the shock absorption system as shown in FIGS. 1–3.
Figure 5:
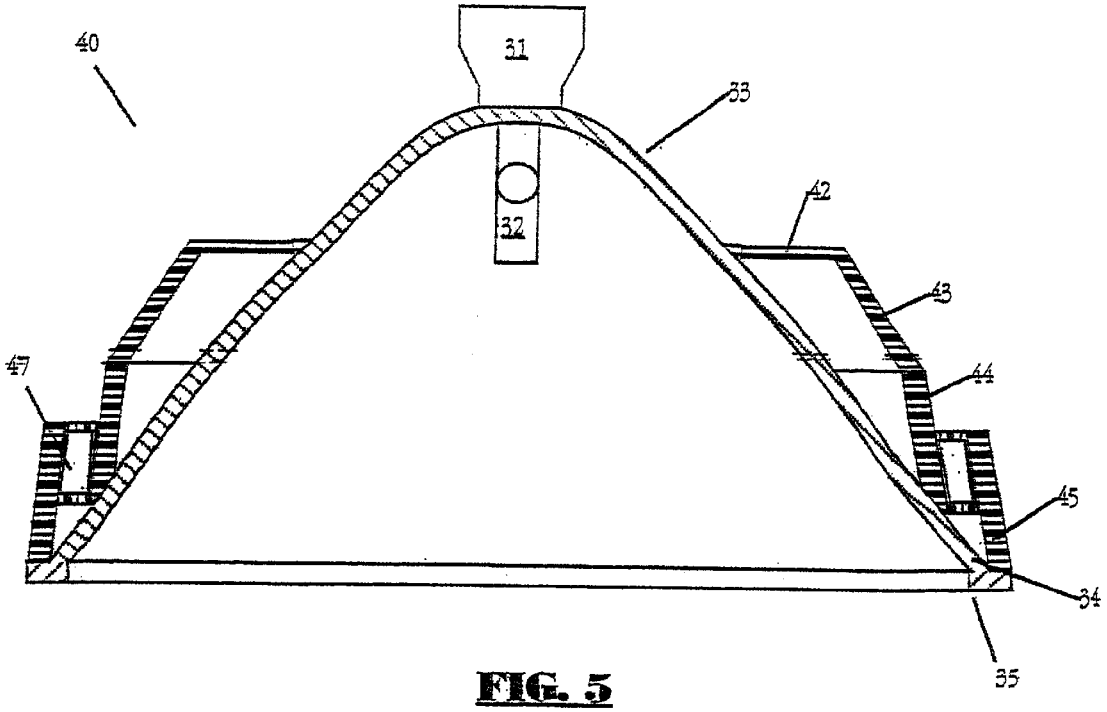
FIG. 5 is cross section of the shock absorption system, reflector, and bulb shown in FIG. 3.
Figure 6:
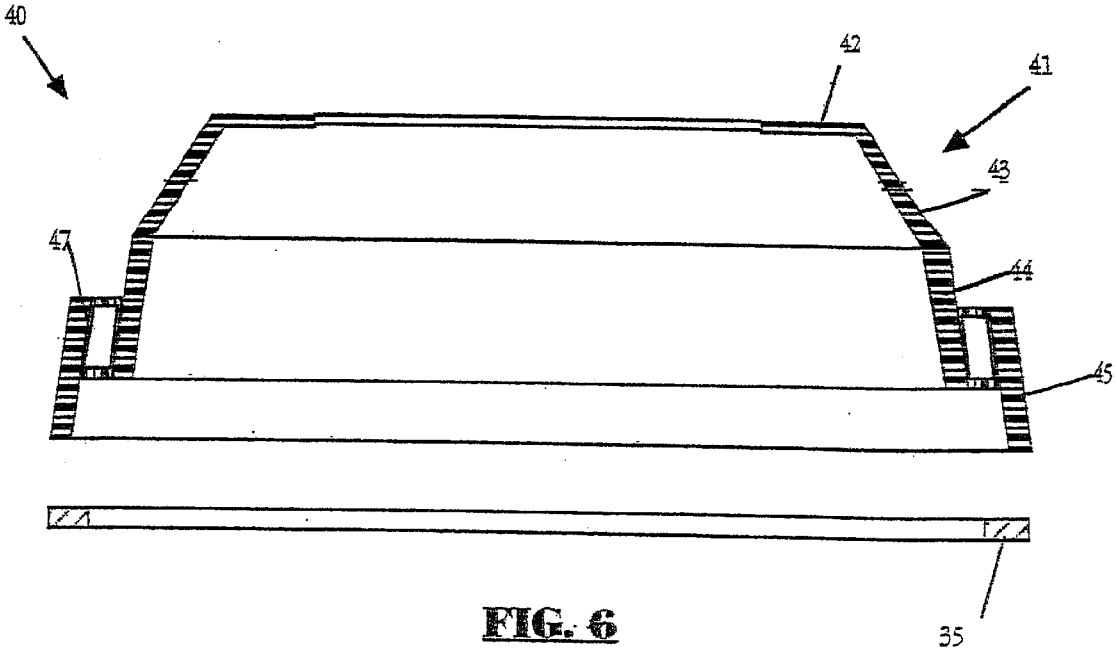
FIG. 6 is a cross section of the shock absorption system shown in FIG. 4.
Figure 7:
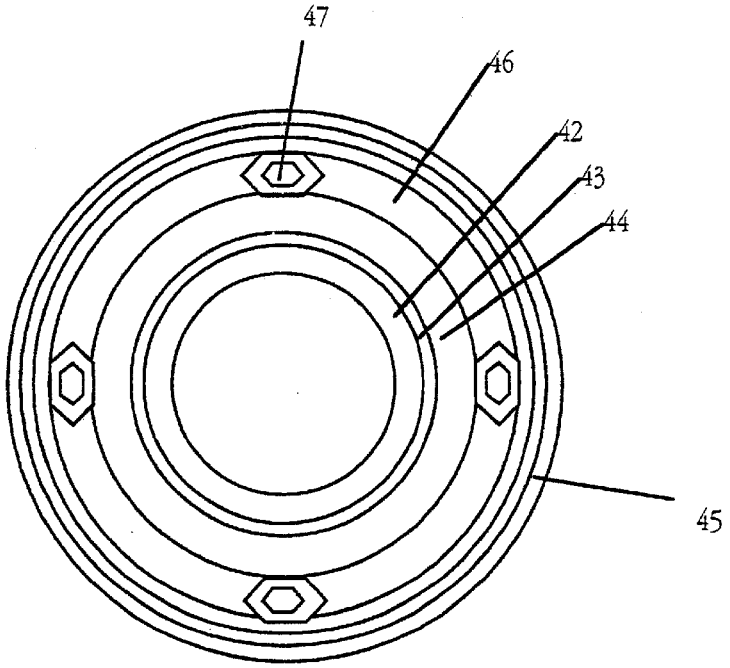
FIG. 7 is an elevational top view of the shock absorption system of the flashlight shown in FIGS. 1–6.
Figure 8:
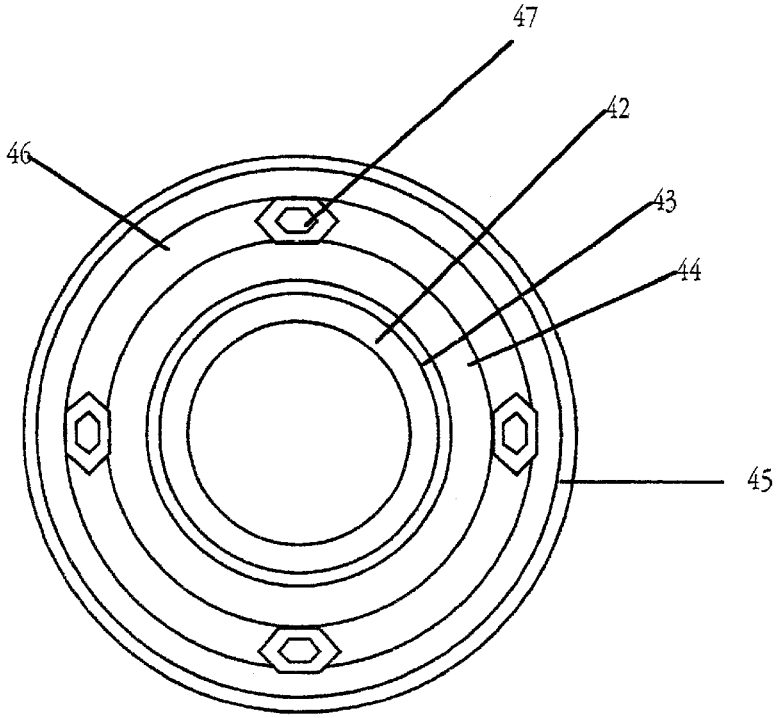
FIG. 8 is an elevational bottom view of the shock absorption system shown in FIGS. 1–7.
Figure 9:
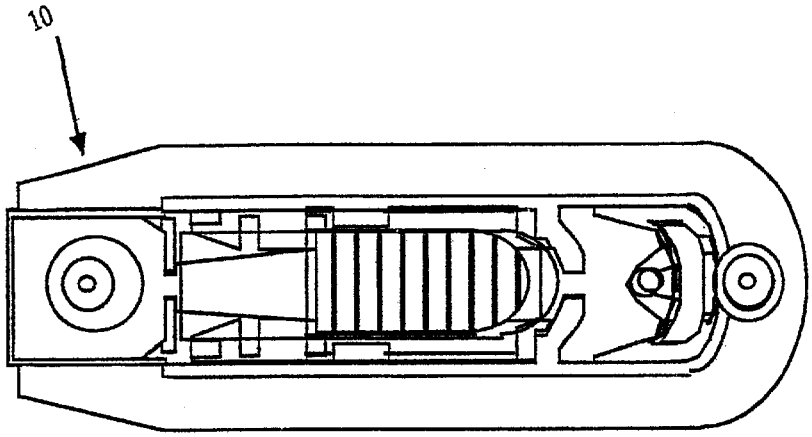
FIG. 9 is an elevational top view of the switch assembly of the invention shown in FIG. 1.
Figure 10:
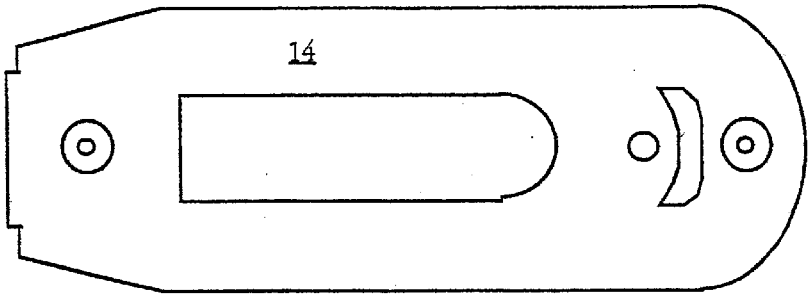
FIG. 10 is a schematic elevational view of a switch plate of the invention.
Figure 11:
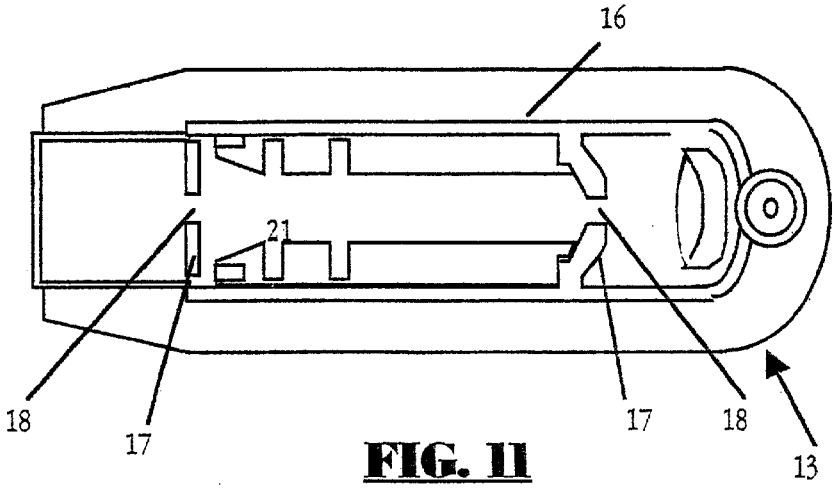
FIG. 11 is a schematic elevational view of a recess usable in the switch assembly of the invention.
Figure 12:
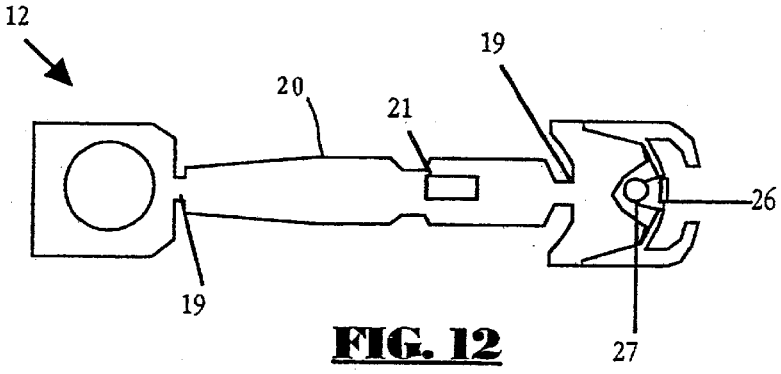
FIG. 12 is a schematic elevational top view of a guide usable in the invention.
Figure 13:
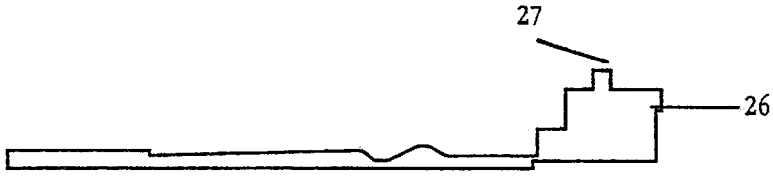
FIG. 13 is a schematic side view of the guide shown in FIG. 12.
Figure 14:
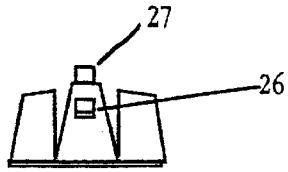
FIG. 14 is a schematic front view of the guide shown in FIGS. 12 and 13.
Figure 15:
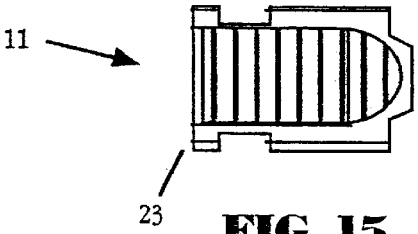
FIG. 15 is a schematic top view of a switch block usable in the invention.
Figure 16:
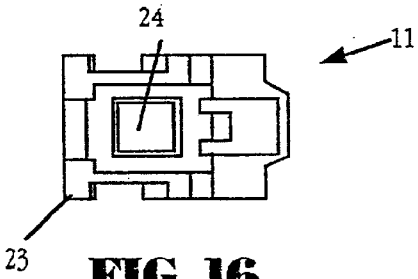
FIG. 16 is a schematic bottom view of the block shown in FIG. 15.
Figure 18:
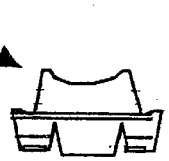
FIG. 18 is a schematic front view of the block of FIGS. 15–17.
Figure 17:
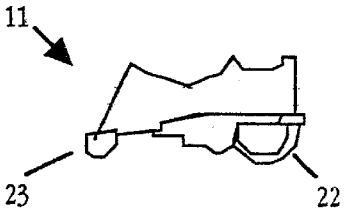
FIG. 17 is a schematic side view of the block of FIGS. 15–16.
Figure 19:
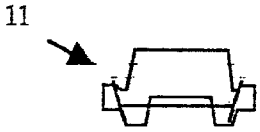
FIG. 19 is a schematic rear view of the block of FIGS. 15–18
Figure 20:
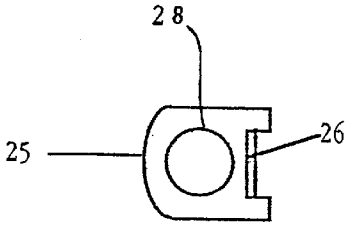
FIG. 20 is a schematic side view of a shoulder strap mount usable in the invention.
Figure 21:
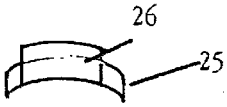
FIG. 21 is a schematic bottom view of the shoulder strap mount of FIG. 20.

The invention is part of a flashlight 1 shown generally in FIGS. 1 and 2 with a bell 2, handle 3, and butt 4, the butt 4 including a cap 5 and the bell 2 including a retainer 6. Outer bell and butt seals 7, 8 engage the retainer 6 and cap 5, respectively, to provide water resistance. An inner butt seal 38 sits in cap 5 and engages a rear edge of butt 4 when cap 5 is on butt 4. A switch assembly 10, including a switch block 11, provides control over power to the bulb 32 of the flashlight 1.

As seen in FIGS. 2–8, the invention includes a shock-resisting member 40 of resilient material in the bell 2 that supports the reflector 33 and helps to seal against water leakage into the bell 2. The member 40 has an inner portion 41 with a thin annulus of material 42 at the rear and a frustroconical middle section 43 that extends between the rear section and a front annular section 44. The rear thin annulus 42 is thicker radially than longitudinally, its inner periphery engaging the rear of the reflector 33 and its outer periphery joining the rear of the middle section. An outer portion 45 of the member is substantially annular and its outer periphery engages the inner periphery of the mouth of the bell 2 to prevent rotation and backward motion of the member 40. The outer periphery of the outer portion 45 and inner periphery of the bell 2 preferably include a mechanical arrangement, such as teeth, that allows insertion of the member into the bell 2 in only one orientation to ensure proper assembly. The inner periphery of the bell 2 and the outer periphery of the outer portion 45 also preferably include corresponding marks indicating to the user the proper positioning of the member for quick insertion.

Part of the outer portion 45 overlies the front annular section 44 of the inner portion 41 so that an annular gap extends between the inner and outer portions 41, 45. At the front of the annular gap, and also at the front of the front annular section 44 of the inner portion 41, a thin annulus 46 extends outwardly to the outer portion 45, the thin annulus 46 allowing limited motion of the inner portion 41 of the member 40 forwards, backwards, and sideways so that, in the event of an impact, the reflector 33 can not hit the wall of the bell 2 or any of the components behind the reflector 33, yet still does not experience the full impulse imparted to the flashlight 1 by the impact. A plurality of blocks 47 extend backward from the thin annulus 46 and between the outer and inner portions 45, 41 to further limit motion of the reflector 33 and strengthen the member 40. Preferably, the blocks 40 are substantially hollow. The very front of the member 40 engages a metal ring 35 that rests between the member 40 and a cover gasket 37 that holds the transparent cover or lens 36. A retainer 6 screws down over the mouth of the bell 2 to hold the cover gasket 37, metal ring 35, reflector 33, and member 40 in place and engages an outer gasket 7 mounted on the outer periphery of the bell 2. Together, the cover gasket 37, outer gasket 7, and retainer 6 render the bell 2 water resistant to 100 meters. Preferably, the outer portion 45 includes a metal ring embedded therein to provide extra strength and rigidity. The cover gasket 37 is also arranged to absorb some of the impulse.

The invention also includes a magnetic switch 10, shown in FIGS. 1 and 9–21 that operates the flashlight 1 without intruding into the interior of the casing to provide water and dirt resistance. While magnetic switches themselves are not new, the invention includes an arrangement of the switch that is self-cleaning and easy to replace. A block 11 and a guide 12 sit in a recess 13 in the exterior of the handle 3 casing and retained within the recess 13 by a switch plate 14 held on by screws 15. A gasket around the recess 13 engages the switch plate 14 and the casing of the handle 3 to retard entry of dirt and other debris into the recess 13. The recess 13 includes an outer wall 16 and two cross walls 17 with central apertures 18 through which necks 19 of the guide 12 extend, and between which a body 20 of the guide extends. The guide 12 and recess 13 include detents 21 that hold the block 11 of the switch 10 in off, partial on, and full on positions. The block 11 includes fore and aft runners 22, 23, the fore runners 22 engaging the detents 21 in the guide 12 and the aft runners engaging the detents 21 in the recess 13. The fore runner 22 is preferably resilient and is arranged so that depression of the block 11 into the recess 13 compresses the fore runner 22 and pivots the aft runners 23 out of engagement with detents 21 corresponding to the position the block 11 occupies, thus allowing the user to move the block 11 to a different position. The runners 22, 23 are shaped so that any debris entering the switch 10 is removed by operation of the switch 10, and if it can not be purged in this manner, the switch 10 can be easily disassembled for more intensive cleaning. The block 11 preferably holds a permanent magnet 24 that closes a circuit within the casing of the handle 3 when moved to an on position.

The switch assembly 10 includes a retractable shoulder strap mount 25 in a head of the guide 12 lying between the front cross wall 17 and the front portion of the outer wall 16 of the recess 13. The mount 25 slides in and out of the casing and is held in each position by interaction with mechanical detents 26 that hold in each position until sufficient force is applied to release button 27 to disengage the detents 26. The shoulder strap attaches to a hole 28 in the mount 25 and to a cap attachment point 9 in the cap 5.

The flashlight 1 includes a metal halide bulb 32 mounted in the rear of the reflector 33 that produces an extraordinary amount of light for its size and power consumption. To drive the bulb 32, driving circuitry 30 is mounted in the casing of the handle 3. Driving circuitry for such bulbs is known in the art and so disclosure of the details of its fabrication are unnecessary to enable one to make and use the instant invention. Though the interior of the casing is water-resistant to 100 meters, I encase the circuitry in resinous material to further protect against contamination by water. An additional advantage of encasing the driving circuitry in such a fashion is that the resinous material acts as a heat sink and draws heat away from the driving circuitry.

Parts List

1 Flashlight
2 Bell
3 Handle
4 Butt
5 Cap
6 Retainer
7 Outer bell seal
8 Outer butt seal
9 Cap shoulder strap attachment point
10 Switch assembly
11 Block
12 Guide
13 Recess
14 Plate
15 Screws
16 Outer wall
17 Cross walls
18 Apertures
19 Necks of guide
20 Body of guide
21 Detents
22 Fore runner of block
23 Aft runner of block
24 Magnet
25 Retractable strap mount
26 Strap mount engaging detent
27 Release button
28 Hole
29 Power source/battery
30 Driving circuitry
31 Bulb holder
32 Bulb
33 Reflector
34 Front lip of reflector
35 Washer/metal ring
36 Lens
37 Inner bell seal/Lens holder/cover gasket
38 Inner butt seal
40 Shock resisting member/absorption system
41 Inner portion of resisting member/rear portion

42 Rear annulus
43 Frustroconical middle section
44 Front section
45 Outer portion
46 Thin annulus between inner and outer portions
47 Blocks

What is claimed is:

1. A flashlight having a casing, a bulb, a lens, a power system, a switch, and a shock absorption system including a substantially stationary resilient body and a movable resilient body connected by a resilient connector, the substantially stationary body being supported by the casing and the movable body supporting a reflector that in turn supports a bulb, the movable body and the connector further absorbing impulse energy as the movable body moves in response to an impulse imparted to the flashlight.

2. The flashlight of claim 1 wherein the substantially stationary and movable resilient bodies include coaxial outer and inner annuli, respectively, and a portion of the outer annulus overlies a portion of the inner annulus.

3. The flashlight of claim 2 wherein the connector is a block extending from between the outer and inner annuli.

4. The flashlight of claim 3 wherein the block is hollow.

5. The flashlight of claim 3 wherein the connector is a membrane.

6. The flashlight of claim 1 wherein the movable body includes a reflector support portion that is substantially washer shaped and extends radially inward from a rear end of the movable body to engage the reflector with an inner periphery of the reflector support portion.

7. The flashlight of claim 1 further including a substantially stationary washer abutting the stationary body and the reflector, the washer limiting forward travel of the reflector.

8. The flashlight of claim 7 further including a resilient inner bell seal that sits between a retainer and the washer, supports the lens, and cushions the lens against impulses imparted to the flashlight.

9. The flashlight of claim 8 wherein, in response to pressure applied by the retainer, the inner bell seal sealingly engages the retainer, the washer, the lens, and the casing to aid in preventing entry of water into the casing.

10. A flashlight having a casing, a bulb, a lens, a power system, a switch, a shock absorption system, and a sealing system including:

an inner bell seal that sits substantially within the casing behind a retainer, supports the lens, and engages the retainer and an inner periphery of the casing; and inner and outer butt seals wherein:

the inner butt seal sits in a cap that selectively engages the butt of the casing and engages a rear edge of the butt when the cap is on the butt; and the outer butt seal sits on and engages an outer periphery of the casing at the butt and sits before and engages the cap;

inner bell seal further sealingly engaging the retainer and the casing.

11. The flashlight of claim 10 further including an outer bell seal that sits on and engages an outer periphery of the casing and sits behind and engages the retainer.

12. The flashlight of claim 10 wherein the inner butt seal is substantially annular.

13. A flashlight having a casing, a bulb, a lens, a power system, a shock absorption system, and a switch including:

a block and a guide slidingly supporting the block, the block including one of a natural magnet and a piece of magnetic material;

a switch plate supporting the guide in a recess of an outer surface of the casing;

the block and the guide being configured to purge an interface between them of debris when the block moves relative to the guide;

a follower mounted on an interior of the casing including a natural magnet if the block includes a piece of magnetic material and a piece of magnetic material if the block includes a natural magnet; and a gate connected to and actuated by the follower so that a position of the gate corresponds to a position of the follower, which corresponds to a position of the block.

14. The flashlight of claim 13 wherein the recess includes attachment points, an outer wall, a front cross wall, and a back cross wall arranged in a pattern, and the guide has a shape corresponding to the pattern so that the walls hold the guide against translation in a horizontal plane.

15. The flashlight of claim 14 wherein the front and back cross walls include apertures through which front and back necks of the guide extend, the necks joining a head, body, and tail of the guide.

16. The flashlight of claim 15 wherein the head of guide includes a selectively extendable strap mount retained within the head by a detent when in an unused position, but projecting from the head and through the plate when in a used position.

17. The flashlight of claim 14 wherein the body of the guide includes a detent that provides resistance to moving the block out of a full on position.

18. The flashlight of claim 17 wherein the body includes a second detent that provides resistance to moving the block out of a partial on position in which the bulb of the flashlight emits only a fraction of the light that it emits when the block occupies the full on position.

19. The flashlight of claim 14 wherein the block includes fore and aft runners that cooperate with depressions in the recess to provide resistance to moving the block out of a full on position, the runners also acting to push debris out or a path of the block.

20. The flashlight of claim 19 wherein the block includes a resilient runner that compresses when subjected to force and thereby causes the block to rock forward, thereby lifting the aft runners.

21. The flashlight of claim 20 wherein the recess includes off depressions that receive the aft runners when the block is in an off position and lock the block in the off position unless a user compresses the resilient runner to rock the block forward and lift the aft runners out of the off depressions.

22. The flashlight of claim 20 wherein the recess includes on depressions that receive the aft runners when the block is in an on position to lock the block in the on position unless the user compresses the resilient runner to rock the block forward and lift the aft runners out of the on depressions.

23. The flashlight of claim 22 wherein the on position is a partial on position in which the bulb emits only a fraction of the light that it emits when the block occupies a full on position.

24. The flashlight of claim 13 further including a resilient gasket between the plate and the recess, the gasket retarding entry of debris into a cavity between the outer wall, a portion of the recess without the outer wall, and the plate.

25. A flashlight having a casing with a bell and a handle, a power source, a light bulb, a reflector supporting the light bulb and directing the light therefrom, a switch controlling power to the light bulb, and a shock-resistant reflector support including a resilient body having a narrow end at a rear of the support that is substantially narrower than a wide end at a front of the support, the narrow end engaging and supporting a rear portion of the reflector, the bell supportably engaging an outer periphery of an outer ring at the wide end, the outer ring being a portion of the support that is substantially coaxial with a longitudinal axis of symmetry of the mounting structure and overlying a portion of a coaxial inner ring of the support from whose rear end extends a frustroconical portion including a washer shaped portion at its rear end, the rear end and washer shaped portion of the frustroconical portion comprising the narrow end of the resilient body, and a resilient web extends between the inner and outer rings to connect the rings and allow a predetermined amount of motion of the inner ring relative to the outer ring in response to an impulse imparted to the casing.

26. A flashlight including a shock absorption system, a sealing system, a light source, and a power system, the shock absorption system cooperating with the sealing system and a casing of the flashlight to protect the light source and the power system from shock below a predetermined impulse imparted to the casing and from water pressure below a predetermined amount, the light source including a bulb and a reflector, the power system including a power source and driving circuitry, the shock absorption system including:

two coaxial annuli connected by a membrane extending from a rear of an outer of the two annuli to an outer surface of the inner of the two annuli, the outer annulus being supported by the casing;

two blocks extending from an inner surface of the outer annulus to the outer surface of the inner annulus, the blocks being arranged at substantially equal angular intervals around the inner annulus;

a frustroconical annulus extending from a rear of the inner annulus, a longitudinal axis of the frustroconical annulus lying on the longitudinal axis of the inner and outer annuli; and a supporting member having a washer shape and extending inward from the rear or the frustroconical annulus to support the reflector that in turn supports the bulb;

the sealing system including:

an external bell ring seal mounted on an outer surface of a bell of the flashlight;

a washer that engages a front edge of the outer annulus of the shock absorption system and a front edge of the reflector;

an internal bell ring seal that engages a front edge of the bell and the washer, the internal bell ring seal carrying a lens of the flashlight; and a retainer selectively engaging the casing at a front of the bell of the flashlight and sealingly engaging the external and internal bell ring seals when mounted on the casing;

the power system including:

a power source mounted within the casing;

a self-cleaning magnetic switch controlling the flow electricity from the power source to the bulb, the magnetic switch having an external portion mounted on an exterior of the casing and an internal portion mounted on an interior of the casing, one of the two portions including a permanent magnet so that sliding a block of the external portion in a groove of the external portion causes the internal portion to move in kind, thereby activating the switch, the block and groove being configured to push debris out of the groove when the block slides.

* * * * *